United States Patent [19]

Steinlein et al.

[11] 4,071,162

[45] Jan. 31, 1978

[54] BOTTLE PACK CRATE AND BOTTLE PACK THEREFOR

[75] Inventors: Rudolf F. Steinlein, Munich, Germany; Christina Schoeller, Zuoz, Switzerland

[73] Assignee: Schoeller International GmbH & Co. KG, Munich-Solln, Germany

[21] Appl. No.: 553,845

[22] Filed: Feb. 27, 1975

[51] Int. Cl.[2] ..... B65D 1/24; B65D 25/10

[52] U.S. Cl. ..... 220/21; 206/203; 217/19; 220/72

[58] Field of Search ..... 217/19; 206/203, 201; 220/21, 72; 229/2.5

[56] References Cited

U.S. PATENT DOCUMENTS

| | | | |
|---|---|---|---|
| 2,407,079 | 9/1946 | Howard | 220/21 |
| 2,459,921 | 1/1949 | Comer | 220/21 |
| 2,603,377 | 7/1952 | Mayers et al. | 217/19 |
| 2,821,327 | 1/1958 | Glazer | 217/19 |
| 2,918,379 | 12/1959 | Lurie | 229/2.5 |
| 3,039,651 | 6/1962 | Lang | 206/201 |
| 3,045,863 | 7/1962 | Chelbor | 206/203 |
| 3,171,562 | 3/1965 | Weiss | 229/2.5 |
| 3,178,052 | 4/1965 | Bromley | 206/203 |
| 3,206,020 | 9/1965 | Billingsley et al. | 206/432 |
| 3,357,625 | 12/1967 | Malmgren | 229/2.5 |
| 3,428,207 | 2/1969 | Schoeller | 220/21 |
| 3,517,852 | 6/1970 | Schoeller | 220/21 |
| 3,842,976 | 10/1974 | Dea | 220/21 |
| 3,863,759 | 2/1975 | Prodel | 217/19 |

FOREIGN PATENT DOCUMENTS

| | | | |
|---|---|---|---|
| 1,255,160 | 4/1959 | France | 220/21 |
| 1,320,916 | 2/1963 | France | 220/21 |
| 1,366,608 | 6/1964 | France | 220/21 |
| 478,031 | 10/1969 | Switzerland | 217/19 |
| 758,517 | 10/1956 | United Kingdom | 220/21 |
| 1,152,038 | 5/1969 | United Kingdom | 217/19 |

*Primary Examiner*—George E. Lowrance
*Assistant Examiner*—Allan N. Shoap
*Attorney, Agent, or Firm*—William R. Woodward

[57] ABSTRACT

A crate for beverage bottles and the like has separators for the bottles in the form of clusters of pillars extending upward from the lattice work bottom of the crate, each cluster being centered on the intersection of four bottle cells of the crate. The pillars of the same cluster are separated by one or two vertical slot-like gaps extending to the crate bottom to receive the partitions of a disposable bottle pack, so that the bottles can be loaded in the crate after they have already been placed in the disposable bottle packs in which they will go to consumer. The bottom of the bottle pack is provided with holes to allow the bottle separator pillars of the crate to extend up into the bottle pack. Instead of a single bottle pack fitting into the crate, two or more smaller bottle packs may fit adjacently into the crate, with their adjoining walls fitting into the same slot-like gaps of the pillar cluster. The crate can also be used to transport empty bottles returned after the bottle packs have been thrown away.

2 Claims, 22 Drawing Figures

BOTTLE PACK CRATE AND BOTTLE PACK THEREFOR

This invention relates to bottle crates, particularly to a crate of the so-called low crate type of a design suitable for receiving bottles gathered in one or more paperboard portable bottle packs and also to bottle packs suitable for insertion in such crates. The crates of the present invention may accordingly be appropriately called bottle pack crates.

Rectangular crates of molded synthetic resin material with open lattice bottoms and with partitions dividing the crates into cells are commonly provided for holding bottles, glasses, cups and the like either for transporting the contents, storing them in stacked crates or, in the case of glasses and cups, loading them into washing equipment. In the case of bottle crates, the height of the crate is frequently less than that of the bottles, in which case it is known as a "low" crate and in which case, if the crates are to be stacked, it must be possible to stack the bottom of one crate on the tops of the bottles of the one below.

The value of such bottle crates is generally too great to permit them to be discarded after one use by a retail customer. Arrangements for deposits by the customer to be refunded upon return of the crate involve so much commercial inconvenience that bottled beverages are normally sold in groups at retail only in disposable paperboard packs usually provided with a single handle for carrying in one hand (as compared with the two handles usually provided at each end of the rectangular crate). The paperboard bottle packs, however, are not sturdy enough to protect the contents in wholesale distribution and handling. The transfer of bottles from the crates used for wholesale distribution to the bottle packs for retail distribution is inconveniently time-consuming.

It is an object of the present invention to provide a crate into which bottles already collected in one or more paperboard bottle packs can be inserted for transportation in factory handling and wholesale distribution, in order to avoid completely the transfer of the bottles out of the crates and into bottle packs. The crates heretofore used cannot accomodate paperboard bottle packs having partitions to separate bottles in the pack, because if the crate itself has partitions, these are located where the bottle pack partitions would need to go and if the crate is of the type heretofore made utilizing projecting pillars at the internal intersections of the boundaries of the bottle cells of the crate, these projecting pillars would likewise interfere with the introduction of the bottle pack. It is an object of the present invention to provide a crate into which may be inserted one or more bottle packs provided with at least one partition to separate bottles carried therein.

SUMMARY OF THE INVENTION

Briefly, the bottle separators provided in the crate are of the pillar type extending upwardly from the lattice work bottom of the crate, but these pillar separators are provided in clusters of one or two pairs, one such cluster being centered at each of two locations at which four of the square bottle cells of the rectangular crate are contiguous. In the case of single pair clusters, a single narrow slot-like gap with substantially vertical sides separates the pillars, this gap running parallel to the pair of side walls (i.e. the shorter walls) of the rectangular crate. In the case of pillar clusters consisting of two pairs of pillars, each pillar is in a cell corner and there are two slot-like gaps separating the pillars and running through the cluster at right angles to each other. A crate of the first-mentioned type will accommodate bottle packs having partitions running in only one direction, whereas a crate of the last-mentioned type will accomodate not only such bottle packs but also bottle packs having partitions running in both cell boundary directions, the partitions in each case fitting down into the slot-like gaps between projections of a group so that the lattice-work bottom of the bottle pack is seated on the bottom of the crate. Although the partitions of bottle packs generally do not extend all the way to the bottom of the pack, it is preferable that the depth of the slot-like gaps between clustered pillars of the crate should extend substantially to the bottom structure of the crate, so that bottle packs of various partition designs can be accommodated.

In the case of the currently popular large size of beverage bottles, the crate of this invention may accomodate a single bottle pack, as for example a single six-pack, in which case it could also accomodate a four-pack and a two-pack or three two-packs, if the slot-like gaps traversing the pillar clusters accept the paperboard walls of two adjacent packs, which is readily done.

The pillars are preferably made hollow to save weight and, to facilitate the provision of resilience in these separating members, they are preferably shaped so as to provide fillets in the cell corners they occupy that snugly hold the bottles at least at the bottom of the projections. Preferably the top of the pillars is tapered so as to make insertion of the bottles contained in the packs in which they are loaded somewhat more easy. The fillet surfaces are preferably bounded by a vertical bead at each side and have a radius of concave curvature shorter than the radius of the bottle to be accommodated.

The lattice work of the crate bottom is preferably provided with double ribs along the cell boundaries for better support of the projections, the ribs being doubled at least in the directions of the clefts in those cases in which the clefts run in only one direction. The bottom of each cell is preferably provided with a lattice work of radial and concentrically circular ribs. The walls of the crate are preferably reinforced at the corners and provided with handle holes in the middle of the end walls.

The invention also comprehends a new form of bottle pack suitable for insertion in a crate of the above-described type. Such a bottle pack is provided with holes on the bottom centered on points of the bottom at which four adjoining cells are contiguous. Preferably these bottle packs are also provided with holes half the size of the aforesaid holes along at least one pair of walls so that the bottle pack can be placed into a crate which it does not wholly occupy and adjoin in the same crate other bottle packs at one or both walls of such pair of walls. In the case of a two-pack, only the latter holes, usually in semicircular shape, might be provided where the single partition of the two-pack intersects the longer wall of the two pack.

The invention is further described by way of example with reference to the annexed drawings, in which.

Figure 1:
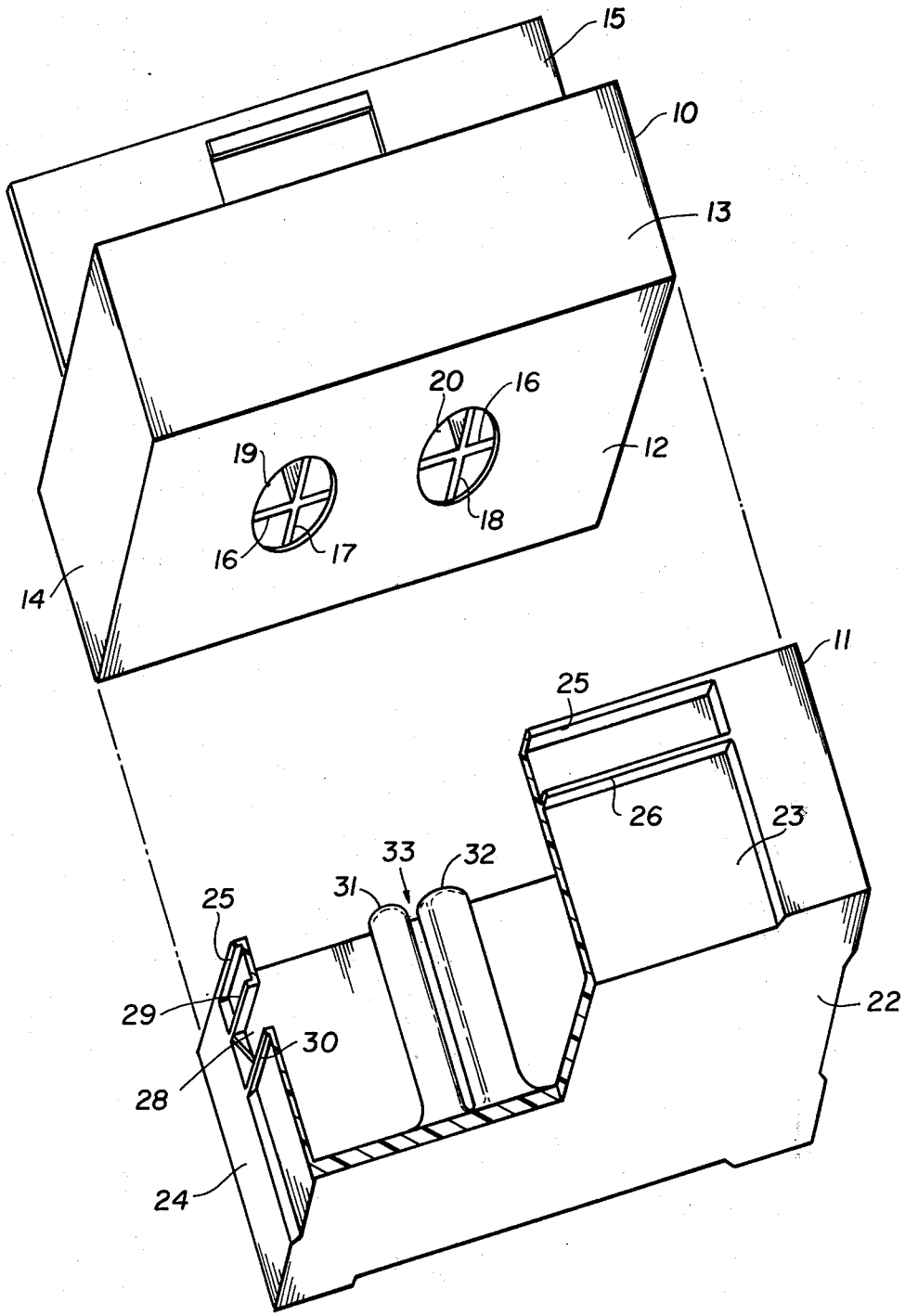
FIG. 1 is an exploded perspective view, partly in section, of a crate according to the invention accomodating a six-pack of beverage bottles, the bottles being omitted to simplify the illustration.

As shown in FIG. 1, a disposable bottle pack 10, which is a six-pack for large bottles is shown above the bottle pack crate 11 into which its fits. The bottle pack 10 is made of paperboard and has a bottom 12, side walls 13, end walls 14, a handle member 15, a longitudinal partition 16 and two transverse partitions 17 and 18, all made of paperboard sheet, such as heavy cardboard. The partitions 16, 17 and 18 are shown as extending all the way down to the upper surface of the bottom 12, but of course it may be convenient from the point of view of manufacture of the bottle pack 10 to have only some of these partitions, or perhaps none of them, extend that far down in the pack, since the partitions can serve to separate the bottles and deaden the shock when they are propelled towards each other even when the partitions do not extend all the way to the bottom. On the other hand, particularly from the point of view of stiffening the bottle pack, it may be desirable to have the partitions, or some of them, extend close to the bottom. The bottle pack crate 11 likewise has a bottom 22, sidewalls 23, and end walls 24. The bottom preferably has an open work structure of the type shown in part of FIG. 9 and generally resembling the structure of FIG. 12 with changes to be pointed out further below, for the purpose of drainage and to provide a good balance between strength and weight. The walls of the crate also may be made of lattice work if desired instead of solid as shown in the drawings. The walls are provided with a reinforcing top flange 25. The side walls also having a reinforcing rib 26 and the end walls 24 are provided with handle holes 28 above and below which are reinforcing flanges 29 and 30.

The distinguishing feature of the crate shown in FIG. 1 is the clustered pair of pillars 31 and 32 extending upward from the bottom 22 and molded as part of the crate which is preferably molded in one piece. The pillars 31 and 32 are separated by a striaght narrow slot-like gap 33 into which the partition 17 of the bottle pack 10 fits. The plane of the longitudinal section shown in the left-hand portion of FIG. 1 passes down the middle of a similar slot-like gap between the pillars 31 and 32 and another pair of pillars, not shown, symmetrically arranged on the other side of it, so that the cluster of projections that pass through the hole 19 when the bottle pack 10 is inserted into the crate 11 consists of four pillars, each of roughly triangular shape as seen from the top, although preferably arcuately concave on the side facing the bottles.

These pillars of one cluster are separated from each other by two intersecting slot-like gaps as will be further described below with respect to FIG. 9, for the purpose of accomodating the partitions 16 and 17. A similar cluster of four pillars, not visible in FIG. 1 is provided for projecting through the hole 20 of the bottle pack 10 and similarly accomodating the partitions 16 and 18 of the bottle pack.

Figure 2:
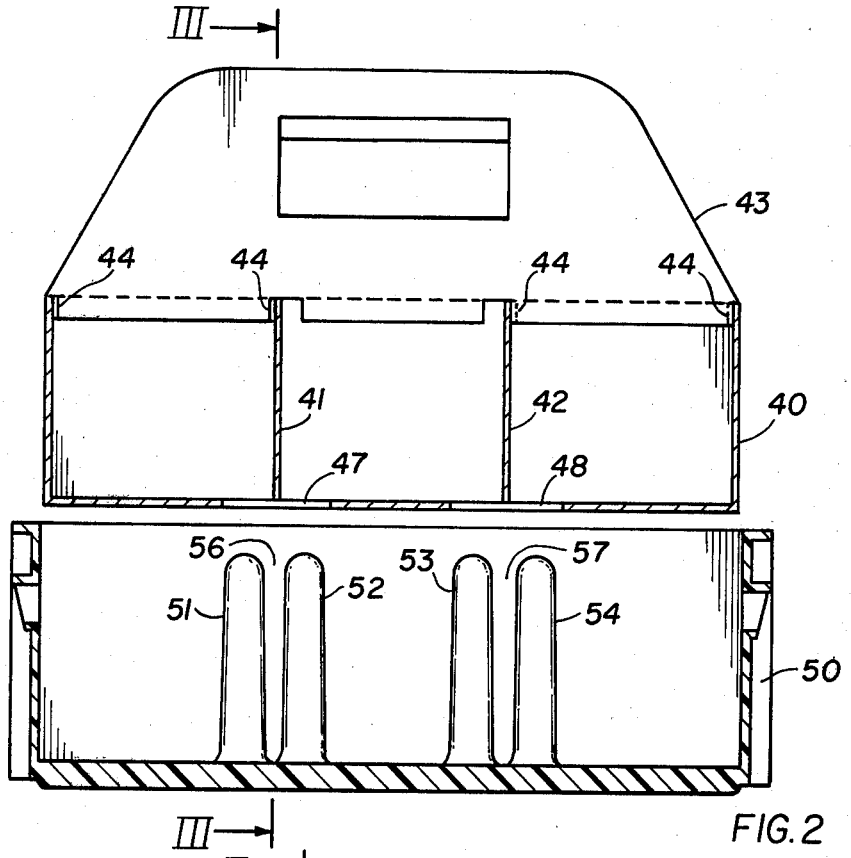
FIG. 2 is an off-median longitudinal cross section of another form of crate and bottle pack according to the invention, likewise showing a six-pack just lifted out of the crate.
Figure 3:
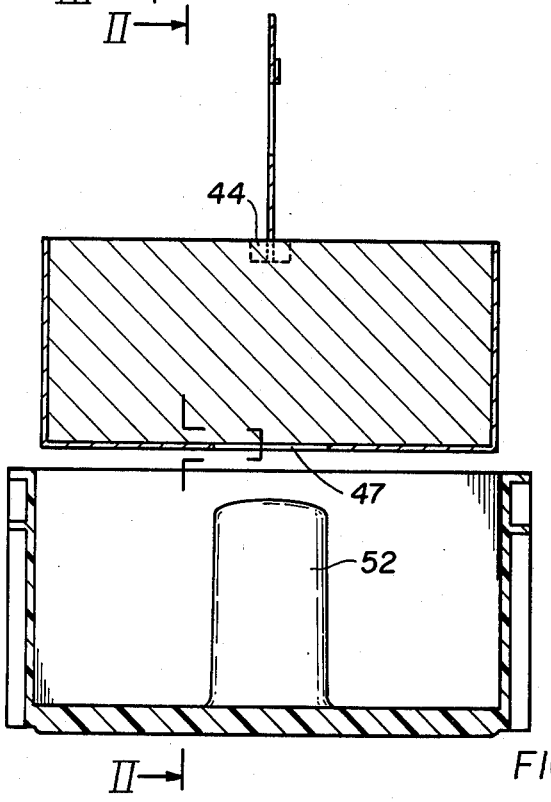
FIG. 3 is a transverse cross section in the plane indicated by the line III—III of FIG. 2, the plane of the cross section shown in FIG. 2 being indicated by the line II—II in FIG. 3.

FIGS. 2 and 3 show, respectively in longitudinal and transverse cross sections, another form of crate and mating bottle pack according to the invention, the planes of the respective cross sections being indicated as already noted. As shown in FIGS. 2 and 3, the bottle pack 40 has transverse partitions 41 and 42 but no longitudinal partition other than the handle member 43 which extends into the space contained by the walls of the bottle pack only far enough to permit securing the handle member 43 by bent tabs 44 suitably staked or bonded to the walls and partitions. It is therefore not necessary to provide a longitudinal slot-like gap between projecting pillars in the interior of the crate 15 to accomodate a longitudinal partition. The bottom and walls of the crate 50 are similar to the corresponding portions of the crate 11 of FIG. 1, except that since the pillars 51, 52, 53 and 54 are different, the open work of the bottom takes the configuration shown in FIGS. 8 and 12 rather than the configuration shown in FIG. 9 as further explained below. The pillars in this case are clustered in single pair clusters, the transverse outline being elongated and bridging the longitudinal middle line, as shown in FIG. 3 where the cross-sectional view faces the relatively straight face of the pillar 52. The lateral shape of the pillars in this case is that of a shallow wedge, preferably with arcuate sides, as more fully explained in connection with FIG. 8. The holes 47 and 48 in the bottom of the bottle pack 40 may again be conveniently round, but of course they may be any shape so long as they are large enough to allow a pair of pillars 51, 52, or 53, 54 to pass through. The pillars of the pairs 51, 52 are separated by a slot-like gap 56 accomodating the partition 41 and the pillar of the pair 53, 54 are separated by a slot-like gap 57 for accomodating the partition 42.

Figure 4:
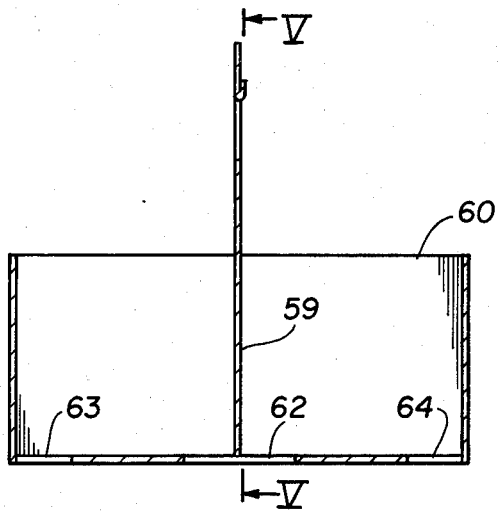
FIG. 4 is a cross section of a four-pack for bottles according to the invention.
Figure 5:
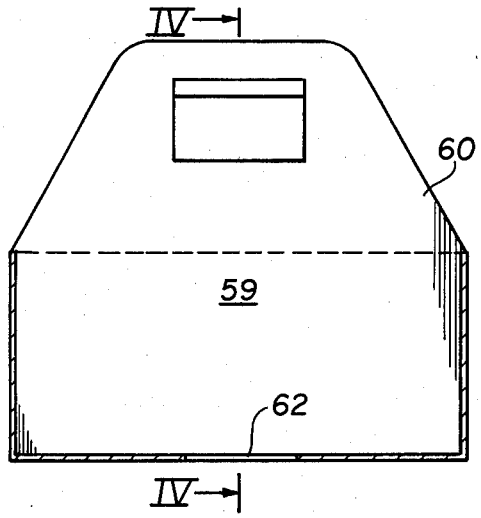
FIG. 5 is a cross section of the bottle pack of FIG. 4 along the line V—V of FIG. 4, the plane of the cross section of FIG. 4 being shown on the line IV—IV in FIG. 5.
Figure 6:
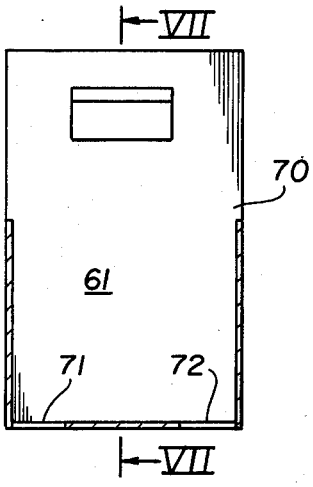
FIG. 6 is a cross section of a two-pack for bottles in accordance with the invention.
Figure 7:
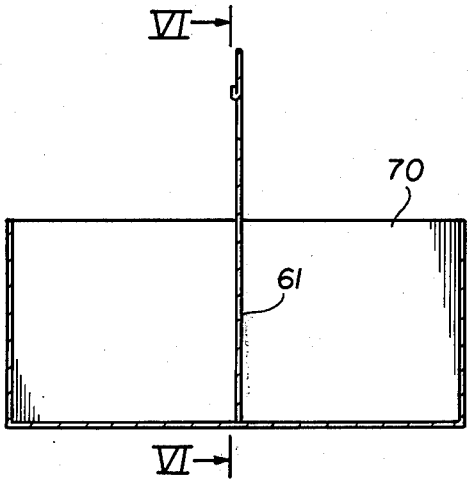
FIG. 7 is another cross section of the two-pack of FIG. 6 along the median line VII—VII of FIG. 6, the plane of the cross section of FIG. 6 being shown by the line VI—VI in FIG. 7.

The crate 11 is suited not only to accomodate a six-pack such as the bottle pack 10, but also to accomodate three two-packs such as shown in FIGS. 6 and 7 or a four-pack such as shown in FIG. 4 and FIG. 5 together with a two-pack such as shown in FIGS. 6 and 7. The slot-like gaps 56 and 57 are wide enough to accomodate not merely a partition such as the partitions 41 and 42 of the pack 40 or the partition 59 of the pack 60 of FIG. 4 or the partition 61 of the pack 70 of FIG. 7, but also a pair of adjacent external walls of two adjacent packs inserted in the crate.

The four-pack shown in FIGS. 4 and 5 not only have the central hole 62 to accomodate a pair of pillars such as the pillars 51 and 52 in the center of the pack but also holes 63 and 64, preferably semicircular designed to adjoin one of the holes 71 and 72 of the two-pack shown in FIG. 6 and FIG. 7 that may be inserted alongside on one side or the other of the four-pack within the six-cell crate 50.

Figure 8:
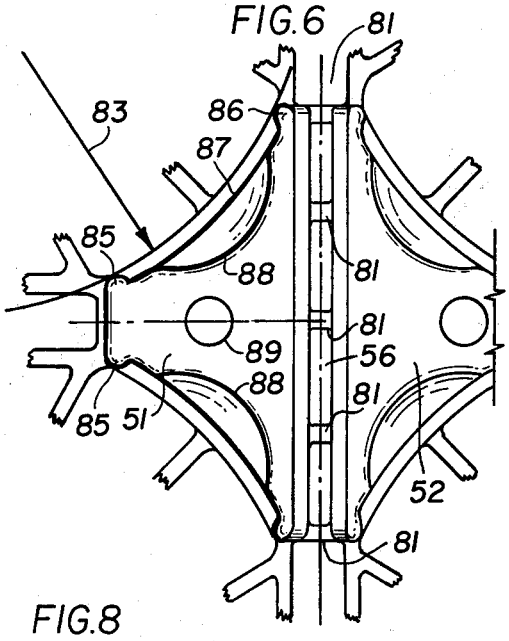
FIG. 8 is a top view of a portion of a crate of the type of FIGS. 2 and 3 in the neighborhood of the intersection of two cell boundaries of the crate.
Figure 12:
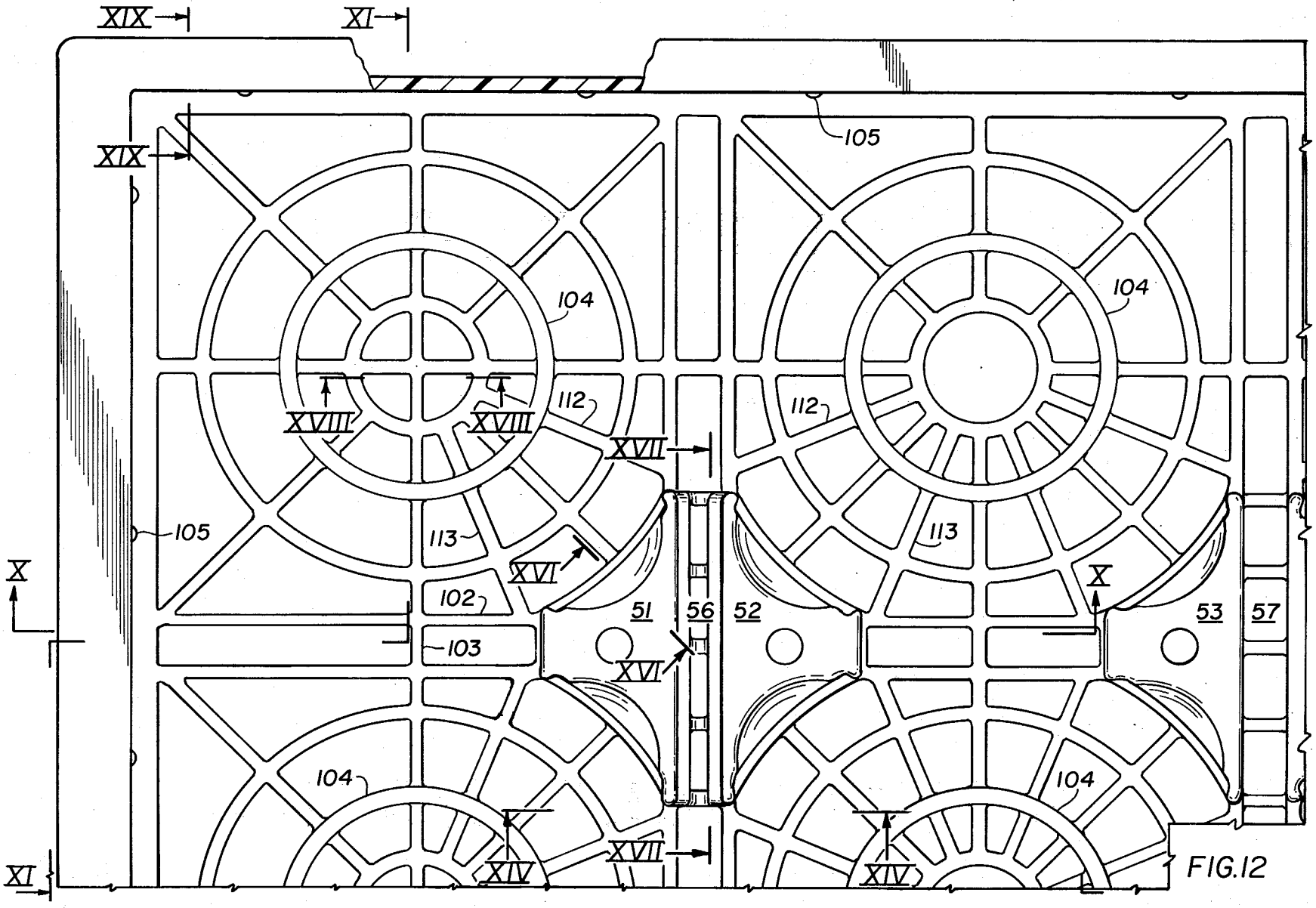
FIG. 12 is a top view, partly in section, and partly broken away, of the crate of FIGS. 10 and 11 including one corner and two cells thereof.

FIG. 8 is a top view of one clustered pair of the bottle separating pillar of the bottle pack crate shown in FIGS. 2 and 3. The pillar 51 is shown and a portion of the pillar 52 and the ladder ribs 81 are seen down the slot-like gap 56 between the two pillars. The ribs 81 are part of the lattice work of the crate bottom. The general plan of the crate bottom is shown in FIG. 12. The radial arrow 83 points to the circumference position of a bottle which is of the size that the crate is intended to fit snugly. The pillar 51, which is outlined in heavy lines in order to distinguish it from the other detail shown in FIG. 8, is seen to touch the bottle periphery only at the vertical ribs 85 and 86. The arcuate sides of the pillar are recessed along the line 87 in their lower portions and in their top portions they are further recessed, so that they meet the top of the pillar along the indented arcuate lines 88.

A hole 89 is provided at the top to facilitate cleaning the crate.

Figure 9:
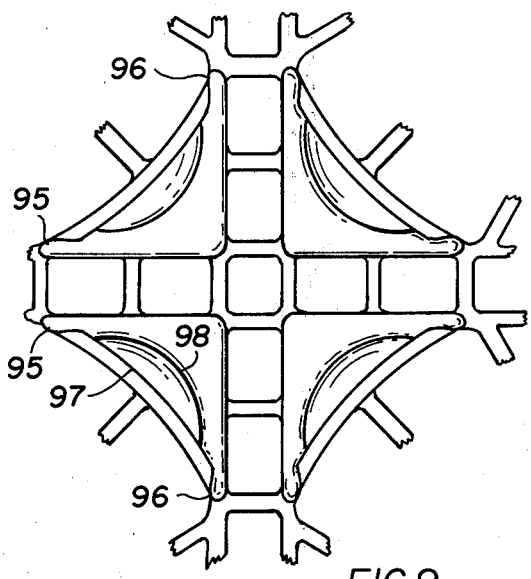
FIG. 9 is a top view of a corresponding portion of a portion of the interior of a crate of the type shown in FIG. 1.

FIG. 9 shows the corresponding top view of a cluster of pillars of the crate shown in FIG. 1. It will be seen that the shape of the pillar cluster is substantially the same in FIG. 9 as in FIG. 8, except that a second slot-like gap, which runs horizontally on the drawing, is provided dividing the pillar cluster into four pillars instead of only two. The vertical ribs 95 and 96 correspond to the ribs 85 and 86 of FIG. 8. The arcuate contours 97 at the lower part of the projections correspond to the contours 87 of FIG. 8 and, likewise, the contours 98 at the tips of the pillars correspond to the contours 88 of FIG. 8. In this case no perforation of the pillar is shown at the top corresponding to the hole 89 of FIG. 8, but of course such a perforation could be provided if desired.

Figure 10:
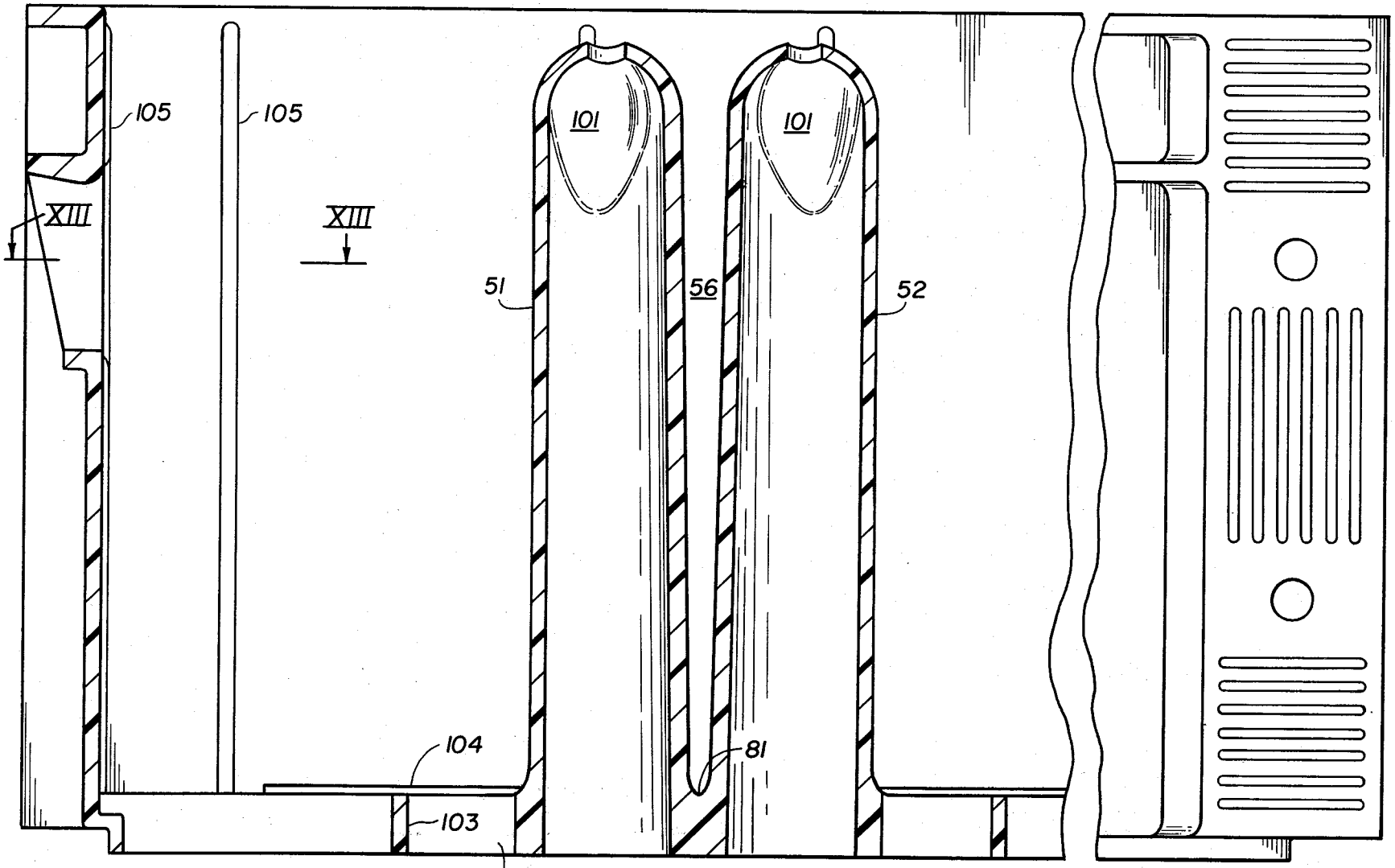
FIG. 10 is a side elevation, partly in longitudinal median section, of a crate according to the invention of the type shown in FIG. 2 and FIG. 3.

FIG. 10 is a longitudinal vertical section along the line X—X shown in FIG. 12. It here appears that the pillar are hollow. The tip indentation that appears between the contours 87 and 88 of FIG. 8 corresponds to the area 101 in FIG. 10, which shows that this indentation in the arcuate side of the pillar (viewed in the sectional view of FIG. 10 from the inside) is located only at the top of the pillar.

The rib 81 at the bottom of the slot-like gap 56 is seen in FIG. 10 from the side. FIG. 10 shows, in longitudinal vertical section, also the structure of the bottom. The longitudinal lattice member 102 shown in FIG. 12 is seen from the side in FIG. 10 and the cross rib 103 is seen in section. The middle circle 104 stands a little higher than the rest of the bottom structure, as is shown in the side view of FIG. 10. FIG. 10 also shows the cross-section of the end wall of the crate already described in connection with FIG. 2 and FIG. 3. FIG. 10 also shows the contour of the vertical bead ridges 105 on the inside of the crate walls, which also appear in FIG. 12 in a top view.

The righthand portion of FIG. 10 shows the outside appearance of the side wall of the crate, the elevation view portion of FIG. 10 being broken away from the remainder to indicate that the side of the crate is much longer than is shown, for convenience of illustration.

Figure 11:
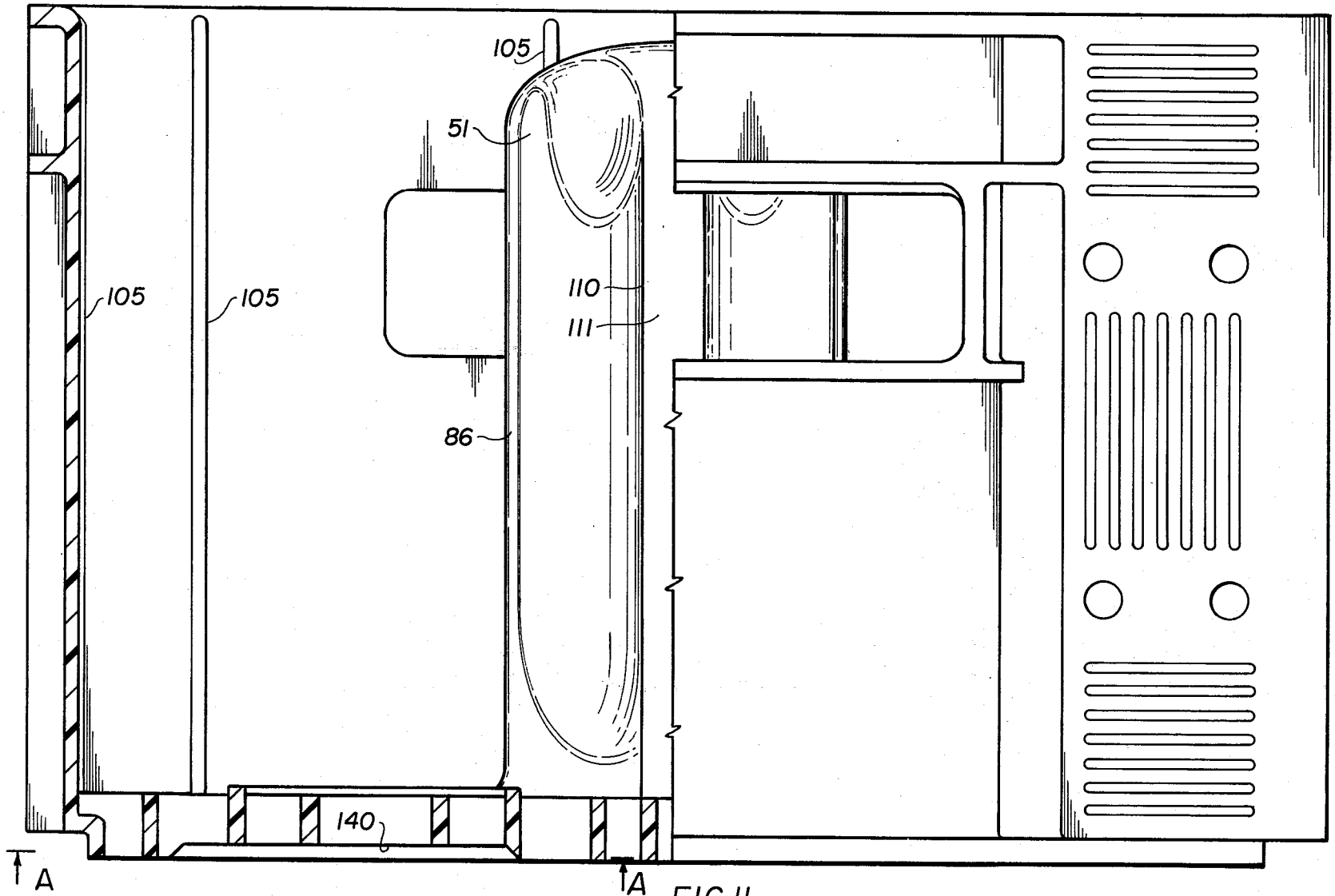
FIG. 11 is an end elevation, partly in section, of the crate shown in FIG. 10, the plane of the sectional portion being shown by the line X—X in FIG. 12.

FIG. 11 is an end view of the crate of FIGS. 2 and 3, with the lefthand portion being shown in section along the line XI—XI shown in FIG. 12. In the pillar 56 the vertical ridge 86 is clearly evident at the left, but the ridge 85 is seen only edge-on and the line 110 indicates this edge, the area to the right thereof being the flat face 111, which is indicated also in FIG. 8 and which extends between the two ridges 85 and, hence, between the two contours 87 of the pillar.

FIG. 12 is a top view of a portion of the crate of FIGS. 2 and 3 covering two complete bottle cells and portions of two others all in the neighborhood of one corner of the crate. The lattice work of the bottom of the crate consists of a system of three concentric circles in each bottle cell crossed by radial ribs, this system for each bottle cell being enclosed in a double-rib rectangular lattice directed along the cell boundaries, one rib of this double-rib lattice on each side of the cell boundary. The major radicals of the bottle cell lattice, which is to say those which are parallel to one pair of end walls of the crate, continue across the cell boundary lattice. These radials are the only ones which also continue inside the smallest circle of the bottle cell lattice and they do so only in the corner cells. Finally, it is to be observed that in those quadrants of the bottle cell lattice in which a bottle separating projection is located, there is an additional pair of radials 112, 113.

Figure 13:
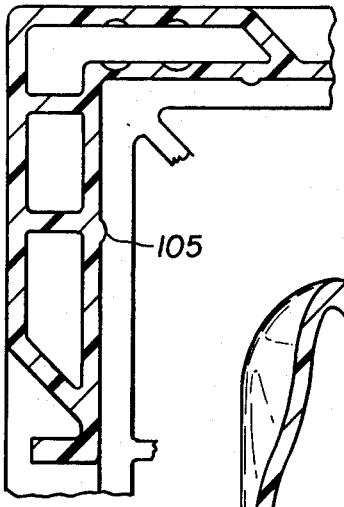
FIG. 13 is a cross section of a corner of the crate of FIG. 10 along the line XIII—XIII of FIG. 10.

FIG. 13 is a horizontal cross-section of the corner portion of the crate at a level indicated on FIG. 10 at XIII—XIII.

Figure 14:
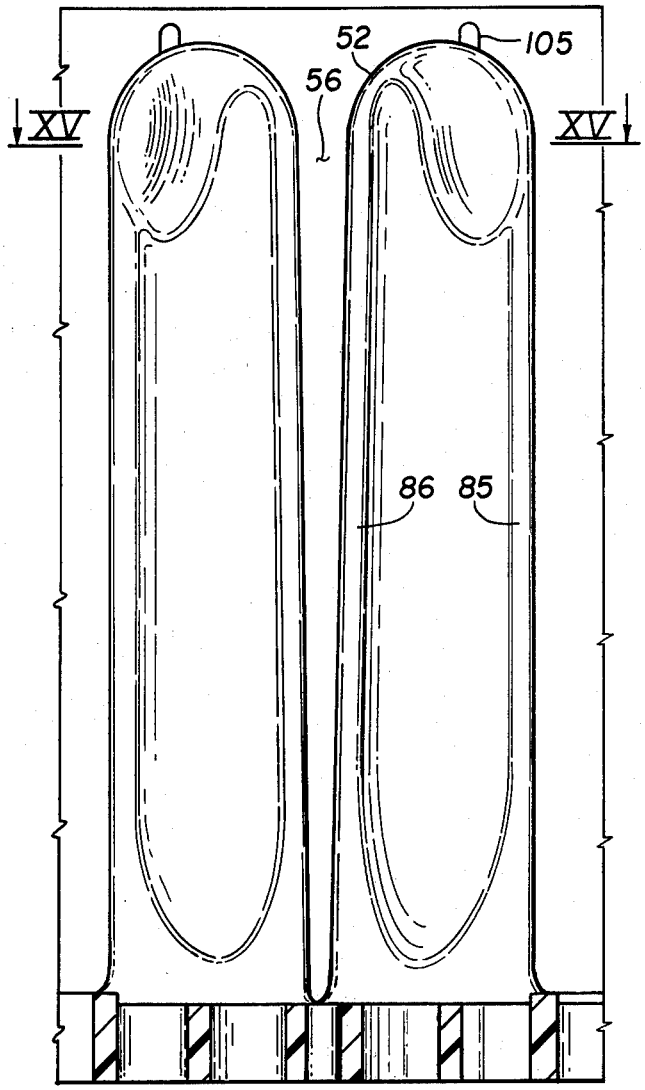
FIG. 14 is a partial cross-sectional view of the crate of FIGS. 10, 11 and 12 along the line XIV—XIV of FIG. 12.

FIG. 14 is a side view of a pair of pillars, in effect a partial vertical longitudinal cross-section of the crate along the line XIV—XIV of FIG. 12 and looking towards the pair of projections which appear immediately above the line XIV—XIV on FIG. 12. In this view, the ridges 85 and 86, seen in cross-section in FIG. 8, are clearly visible.

Figure 15:
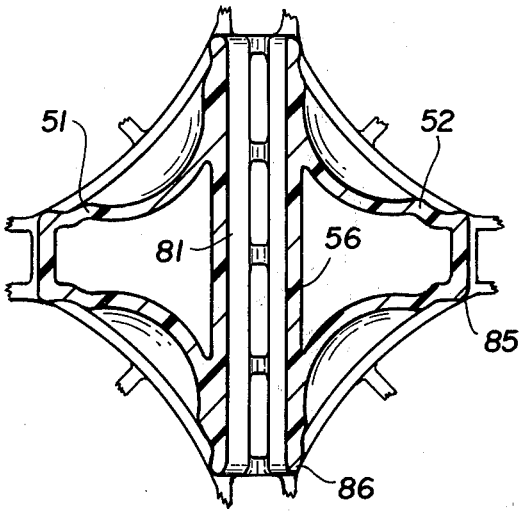
FIG. 15 is a cross-sectional view of a portion of the crate of FIGS. 10, 11 and 12 along the line XV—XV of FIG. 14.

FIG. 15 is a horizontal cross-section of the upper part of a pair of pillars, along the line XV—XV of FIG. 14 looking down from the plane of the cross-section.

Figure 16:
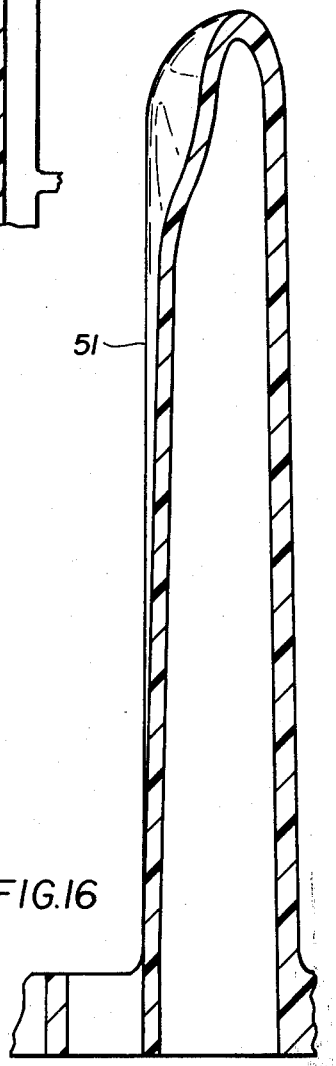
FIG. 16 is a cross-sectional view of a portion of the crate of FIGS. 10, 11 and 12 including one of the internal projections thereof, taken along the line XVI—XVI shown in FIG. 12.

FIG. 16 is a diagonal cross-section in a vertical plane of a pillar of the crate of FIG. 2 and FIG. 3, which is given to show the recessed surface near the tip of the pillar, this cross-section being in a vertical plane passing through the line XVI—XVI of FIG. 12.

Figure 16A:
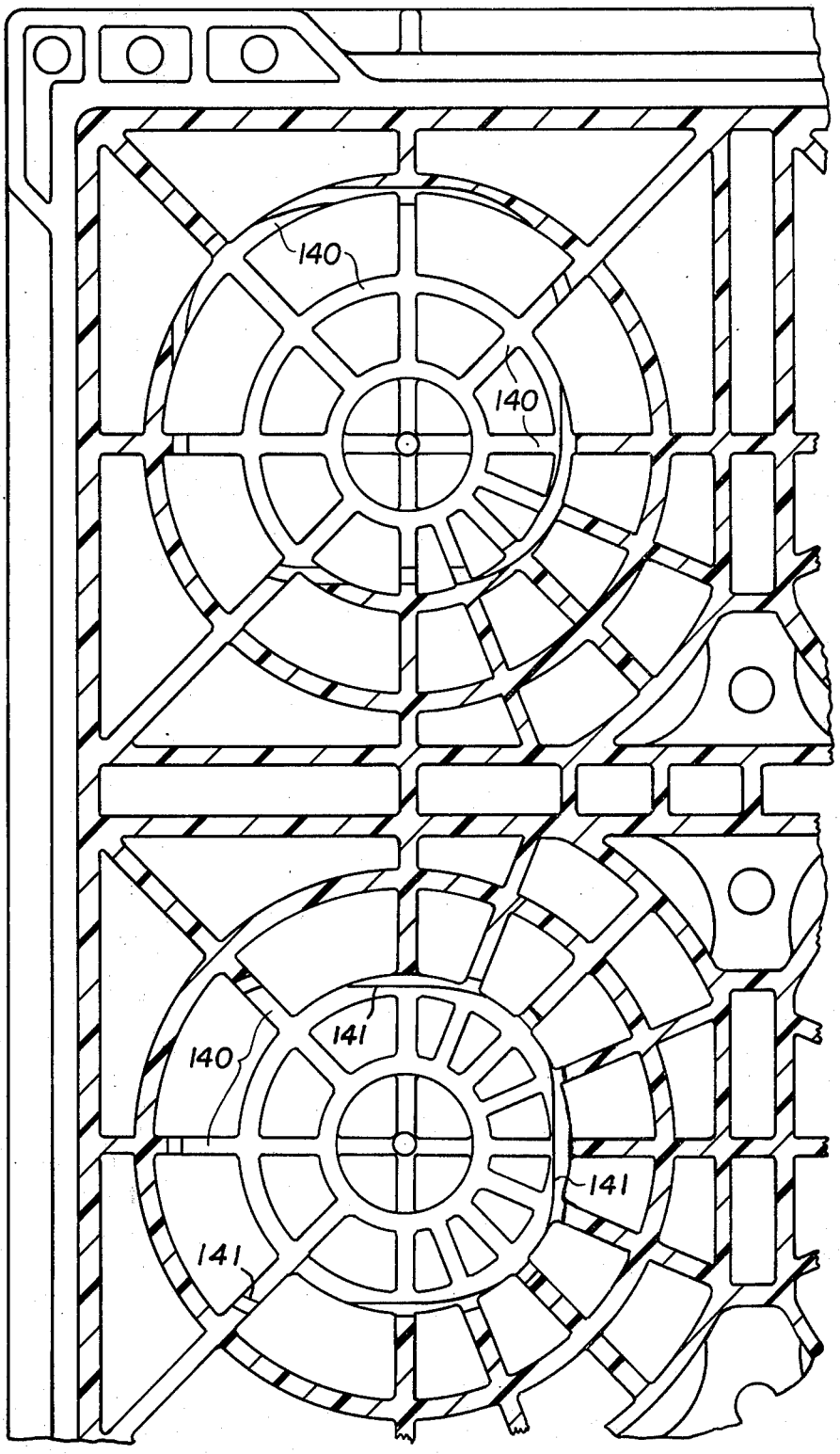
FIG. 16A is a horizontal cross section of part of the bottom of the crate of FIGS. 2 and 3, through the line A—A of FIG. 11.

It will be noted on FIG. 11 that the lattice-work bottom of the crate is not flush with the bottom plane on which the crate sits, there being some recessed portions indicated by the recess 140. The shape of this recess is shown in FIG. 16a, which is a horizontal cross-section passing through the line A—A shown on FIG. 11. These recesses are not symmetrically located in the bottle cells, although they are symmetrically disposed on the crate bottom as a whole. They are designed to cover all the areas in which the capped top of a bottle may bear against the superposed crate when crates loaded with bottle packs are cross-stacked so as to cross-bond the stack somewhat for its stability. The edges of these recesses are chamfered, as is clear from FIG. 11. The lines 141 in FIG. 16A are some of the lines indicating the inner boundary of the chamfer. In the particular example illustrated, as seen in FIG. 16A, the contour of the corner cell bottom recesses is somewhat different from that of the corresponding recesses in the mid-side cells of the crate.

Figure 17:
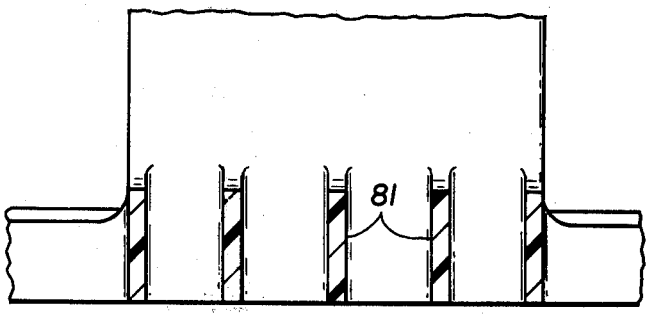
FIG. 17 is a cross section of a portion of the crate of FIGS. 10, 11 and 12 near the base of one of the bottle separator pillars thereof, taken along the line XVII—XVII of FIG. 12.

FIG. 17 is a cross section of the crate bottom in the neighborhood of a pair of pillars, in a plane passing down the slot-like gap between the projection pair and passing through the line XVII—XVII of FIG. 12.

Figure 18:
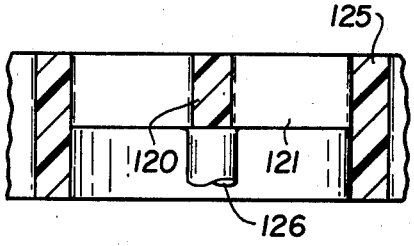
FIG. 18 is a cross section of a portion of the bottom of the crate of FIGS. 10 and 11 and 12, taken along the line XVIII—XVIII of FIG. 12.

FIG. 18 is a longitudinal vertical cross-section of a portion of the crate bottom near the center of a bottle cell taken on the line XVIII—XVIII of FIG. 12 and looking in the direction which is shown as up in FIG. 12. As here shown, the mutually perpendicular radials 120 and 121 do not extend to the bottom of the crate in the space inside the smallest circle 125, and a cylindrical portion 126 extends downward from the center. This is a feature that may be used to facilitate alignment in stacking crates one upon the other, since the cylindrical member 126 would fit into the open neck of a bottle in the crate below. It will be noted in FIG. 12 that only the corner cell is provided with this feature, so that there will be no unnecessary difficulty in aligning crates of empty bottles for stacking.

Figure 19:
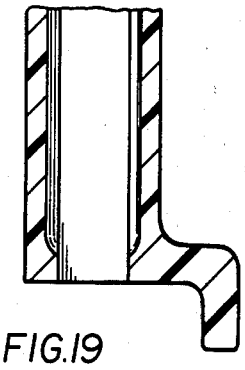
FIG. 19 is a cross section near the bottom of a corner of the crate of FIGS. 10, 11 and 12 taken along the line XIX—XIX of FIGS. 12 and 13.

FIG. 19 is a vertical transverse cross-section of the crate wall and corner reinforcement, showing the bottom part thereof only taken along the line XIX—XIX of FIG. 12. As there shown, the double-wall structure around the corner of the crate is open at the bottom.

Figure 20:
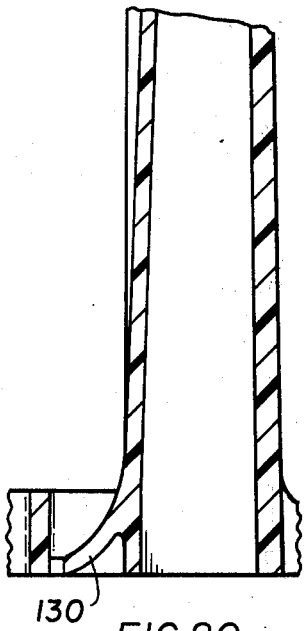
FIG. 20 is a cross section of a portion of a modified form of crate corresponding to the view of the crate of FIGS. 10 and 11 and 12 shown in the lower part of FIG. 16.
Figure 21:
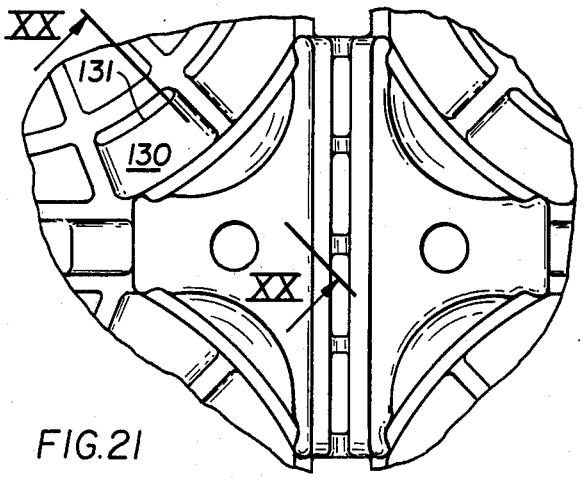
FIG. 21 is a top view of a portion of the modified form of crate shown in FIG. 16 showing the plane of the cross section of FIG. 20 by the line XX—XX.

FIG. 20 is a cross-section of a portion of a modified form of bottle pack crate according to the invention, this modified form of bottle pack crate differing from that shown in FIGS. 2–19 only in the fillet-like reinforcement 130 at the bottom of the bottle separator pillar on its side away from the slot-like gap that runs between this pillar and its cluster mate. FIG. 20 is a diagonal vertical cross-section along the line XX—XX of FIG. 21. FIG. 21 is the corresponding top view of the pillar pair and the neighboring portions of the crate bottom. It will be seen from FIG. 21 that the top view and, hence, the shape of the pillar above the level of the crate bottom is the same as already described and the only difference is the fillet flange 130 at the foot of the pillar, the forward edge of which appears at 131 in FIG. 21.

We claim:

1. A crate for at least six bottles which is capable of crating bottles held in one or more partitioned packs removable from the crate so that the bottles can be held in the pack during loading into the crate and removal therefrom and is also, alternatively, capable of crating unpacked individual bottles without allowing contact of bottles with each other, said crate comprising a lattice-work crate bottom and upstanding side walls forming a rectangular enclosure comprising:

a plurality of clusters of bottle-separating pillars, extending upward from the crate bottom, each pillar cluster being spaced from the crate wall and composed of at least one pair of closely spaced pillars, the pillars of the same cluster being of similar shape and approximately the same size and being separated over substantially all of their height by at least one narrow substantially vertical-sided slot-like gap running parallel to a pair of said crate side walls for receiving bottle pack partitions, said pillar clusters being provided at least at two locations on the bottom of said crate, each said location of a pillar cluster defining adjacent cell corner boundaries of four bottle-receiving areas, and the lateral surface of each of said pillars, which surface faces away from the center of the cluster to which the pillar belongs and towards the center of one of said bottle-receiving areas, having a concave portion concave with a smaller radius of curvature than the distance to a vertical axis through said bottle receiving area and presenting substantially vertical edges respectively at each side of the concave portion for engagement of a bottle by both of said edges.

2. A crate for bottles as defined in claim 1, in which above each of said concave portions of said pillars there is provided an indentation.

* * * * *